US007548217B2

(12) United States Patent
Chang

(10) Patent No.: US 7,548,217 B2
(45) Date of Patent: Jun. 16, 2009

(54) PARTIALLY REFLECTIVE SURFACE ANTENNA

(75) Inventor: The-Nan Chang, Taipei (TW)

(73) Assignee: Tatung University & Tatung Company, Taipei (TW)

( * ) Notice: Subject to any disclaimer, the term of this patent is extended or adjusted under 35 U.S.C. 154(b) by 0 days.

(21) Appl. No.: 12/061,718

(22) Filed: Apr. 3, 2008

(65) Prior Publication Data

US 2009/0115680 A1 May 7, 2009

(30) Foreign Application Priority Data

Nov. 6, 2007 (TW) ..... 96141820 A

(51) Int. Cl.
*H01Q 15/02* (2006.01)

(52) U.S. Cl. ..... 343/909; 343/700 MS; 343/756; 343/912

(58) Field of Classification Search ..... 343/756, 343/700 MS, 912, 755, 853, 909
See application file for complete search history.

(56) References Cited

U.S. PATENT DOCUMENTS

| | | | | |
|---|---|---|---|---|
| 5,455,594 | A * | 10/1995 | Blasing et al. | 343/700 MS |
| 6,597,327 | B2 * | 7/2003 | Kanamaluru et al. | 343/909 |
| 6,759,994 | B2 * | 7/2004 | Rao et al. | 343/912 |
| 6,836,258 | B2 * | 12/2004 | Best et al. | 343/909 |
| 7,161,539 | B2 * | 1/2007 | Chang et al. | 343/700 MS |
| 7,319,429 | B2 * | 1/2008 | Chang et al. | 343/700 MS |

* cited by examiner

*Primary Examiner*—Tho G Phan
(74) *Attorney, Agent, or Firm*—Lowe Hauptman Ham & Berner, LLP

(57) ABSTRACT

A partially reflect surface antenna includes a substrate, a reflective sheet and a plurality of supporting units. The substrate has an upper surface formed thereon a signal I/O for receiving and outputting high frequency signal. The reflective sheet partially reflects the high frequency signal and includes an array antenna block located at the surface of the reflective sheet. The plurality of supporting units support the reflective sheet to locate at the upper surface of the substrate and to maintain a predetermined distance between the reflective sheet and the substrate. The area of the array antenna block ranges from 0.31 to 0.8 times of the surface area of the reflective sheet.

17 Claims, 14 Drawing Sheets

PARTIALLY REFLECTIVE SURFACE ANTENNA

RELATED APPLICATIONS

The present application is based on, and claims priority from, Taiwan R.O.C. Application Number 096141820, filed Nov. 6, 2007, the disclosure of which is hereby incorporated by reference herein in its entirety.

BACKGROUND OF THE INVENTION

1. Field of the Invention

This invention relates to a partially reflect surface antenna, and more particularly to a partially reflect surface antenna capable of increasing aperture efficiency and reducing manufacturing cost of the micro-strip reflective unit of the reflective sheet.

2. Description of Related Art

In the recent years, due to the conventional partially reflective surface antenna with low profile can be made by the print circuit board, and therefore it is widely used in the military or civil industry. However, the aperture efficiency of the conventional partially reflective surface antenna is also limited.

FIG. 1 is a schematic view illustrating a conventional partially reflective surface antenna, wherein the partially reflective surface antenna comprises a substrate 11, a reflective sheet 12, and a plurality of supporting units 131, 132, 133, 134. The substrate 11 and the reflective sheet 12 each is an FR-4 microwave substrate with the thickness of 0.8 mm, and each supporting unit maintains a predetermined distance between the substrate 11 and the reflective sheet 12. Further, the substrate 11 has an upper surface 111 with a signal I/O portion 112 electrically connected to a coaxial cable 113 for receiving or outputting a high frequency signal.

Referring to FIG. 1, an array antenna block 14 locates at the center of the surface of the reflective sheet 12, and the area of the array antenna block 14 is substantially equal to the surface area of the reflective sheet 12. In addition, an antenna array 141 locates inside the array antenna block 14, and the antenna array 141 comprises one hundred and twenty one micro-strip reflective units 142 for forming as an 11×11 array.

In addition, in conventional partially reflective antenna, the reflective sheet 12 is a square-shaped plate with a dimension of 12.9 cm×12.9 cm, and the array antenna block 14 is a square-shaped with a dimension of 12 cm×12 cm. The micro-strip reflective unit 142 composes antenna array 141 of the array antenna block that is formed in a square shape with a dimension of 1 cm×1 cm. In antenna array 141, the distance (Dx1) in the direction of X and the distance (Dy1) in the direction of Y between the two micro-strip reflective units 142 respectively is 1 mm.

The conventional partially reflective antenna can substantially adjust the arrangement of the micro-strip reflective unit 142 for increasing the direction of the high frequency signal. However, the conventional partially reflective antenna only uses metal material to reflect the electrical wave without considering using other material such as insulating material to reflect the electrical wave. Therefore, the conventional partially reflective antenna will cost lots of metal material to manufacture the micro-strip reflective unit and fill them up to the reflective sheet. Also, the conventional partially reflective antenna is unable to use non-metal material to increase the aperture efficiency of the high frequency signal.

Therefore, it is desirable for the industries to provide a partially reflective antenna, which not only can reduce the manufacture cost of the micro-strip reflective unit, but also can increase the aperture efficiency.

SUMMARY OF THE INVENTION

This present invention relates to a partially reflective surface antenna comprising: a substrate having an upper surface formed thereon a signal I/O portion for receiving and outputting high frequency signal; a reflective sheet for partially reflecting the high frequency signal, including a array antenna block located at the surface of the reflective sheet; and a plurality of supporting units for supporting the reflective sheet to locate at the upper surface of the substrate and to maintain a predetermined distance between the reflective sheet and the substrate; wherein an antenna array located inside the array antenna block includes a plurality of micro-strip reflective units, and the area of the array antenna block ranges from 0.31 to 0.8 times of the surface area of the reflective sheet.

This present invention relates to a partially reflective surface antenna comprising: a substrate having an upper surface formed thereon a signal I/O portion for receiving and outputting high frequency signal; a reflective sheet for partially reflecting the high frequency signal, including an array antenna block located at the surface of the reflective sheet; and a plurality of supporting units for supporting the reflective sheet to locate at the upper surface of the substrate and maintain a predetermined distance between the reflective sheet and the substrate. A first antenna array and a second antenna array respectively locate inside the array antenna block, and the second antenna array surrounds the first antenna array. The first antenna array includes a plurality of first micro-strip reflective units, and the second antenna array includes a plurality of second micro-strip reflective units. The distance between the plurality of first micro-strip reflective units is smaller than the distance between the plurality of second micro-strip reflective units, and the area of the array antenna block ranges from 0.31 to 0.8 times of the surface area of the reflective sheet.

Therefore, by controlling the ratio of the area of array antenna block to the surface area of the reflective sheet to keep the area of the array antenna block between 0.31 to 0.8 times of the surface of the reflective sheet, this present invention not only can increase the aperture efficiency, but also can reduce the manufacture cost of the micro-strip reflective antenna. Further, by setting two different kinds of arrangement of the antenna array located at the surface of the reflective sheet, this present invention decreases the side lobe of the high frequency signal outputted by the partially reflective antenna, and therefore the present invention can centralize the main lobe of the high frequency signal, so as to increase the transmitting distance of the high frequency signal and reduce the noise.

This present invention can set any size of the array antenna block on the surface of the reflective sheet, and the area of the array antenna block is preferably between 0.31 to 0.8 times of the surface area of the reflective sheet. The array antenna block of the present invention can be formed in any kind of shape, but preferably the array antenna block is a square or rectangle shape. The micro-strip reflective unit of the present invention can be formed in any kind of shape, but preferably the micro-strip reflective unit is a square or rectangle shape. The substrate of the partially reflective antenna of the present invention can be made as any suitable printed circuit board, but preferably the printed circuit board is an FR-4 microwave substrate, a Duroid™ microwave substrate, or a Teflon™ microwave substrate. The reflective sheet of the present invention can be formed in any kind of shape, but preferably the reflective sheet is a square-shaped plate, a rectangle-shaped, or a circular-shaped plate. The supporting units of the present invention can be any kind of material, but preferably the material is plastics or any insulating material. The distance between the reflective sheet and the substrate is not restricted, but preferably, the wavelength of the high frequency signal ranges from the one-third to two-third of the wavelength of the high frequency signal being transmitted or received by the partially reflective antenna, and the best ratio is half of the wavelength of the high frequency signal being transmitted or received by the partially reflective antenna in this invention. The signal I/O portion of the present invention can be formed in any kind of shape, but preferably the reflective sheet is a square-shaped slot, or a rectangle-shaped slot. The signal I/O portion can electrically connect to any kind of signal cable, preferably, but not limited to the coaxial or a cooper twist cable.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
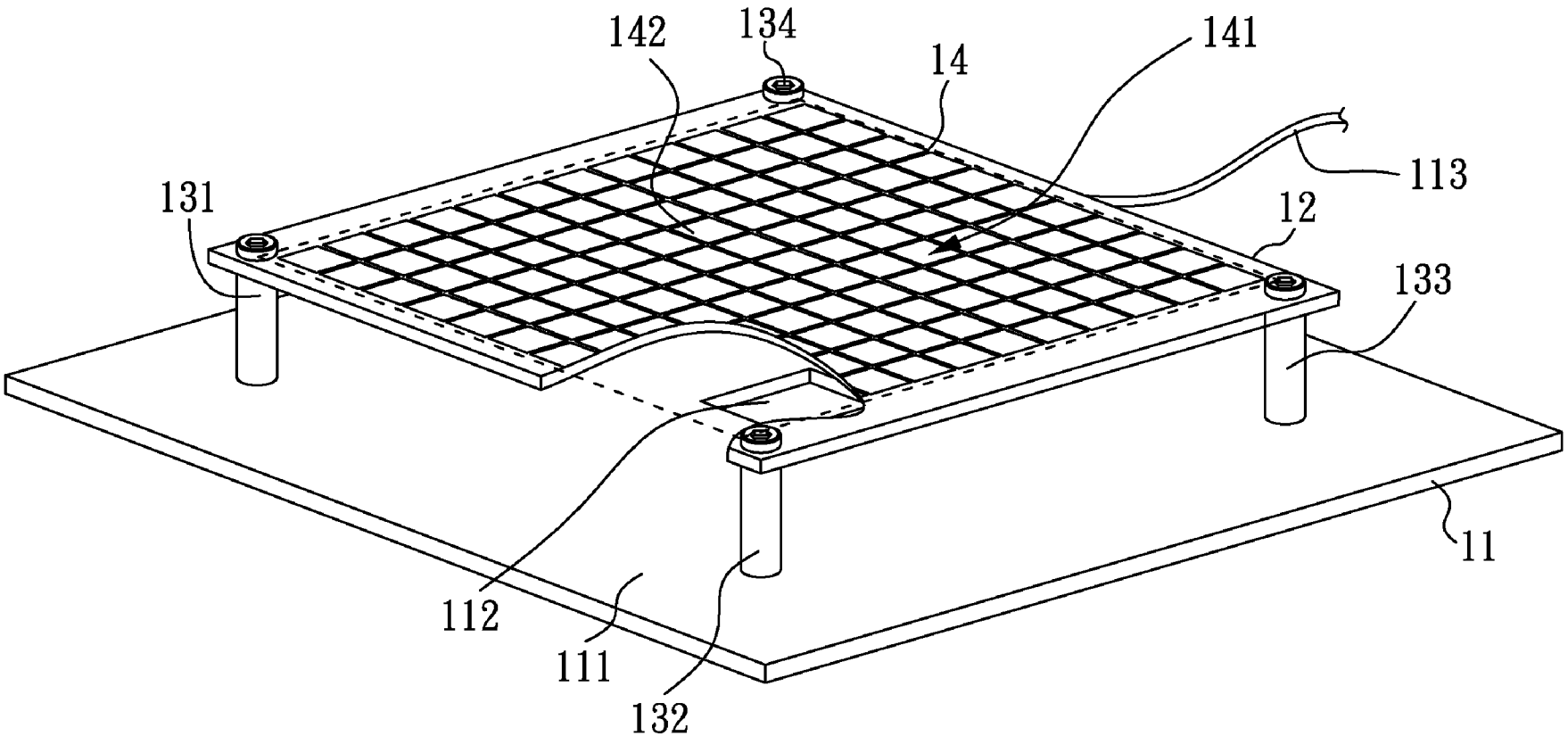
FIG. 1 (Prior Art)
FIG. 1 is a schematic view illustrating a conventional partially reflective surface antenna.
Figure 2A:
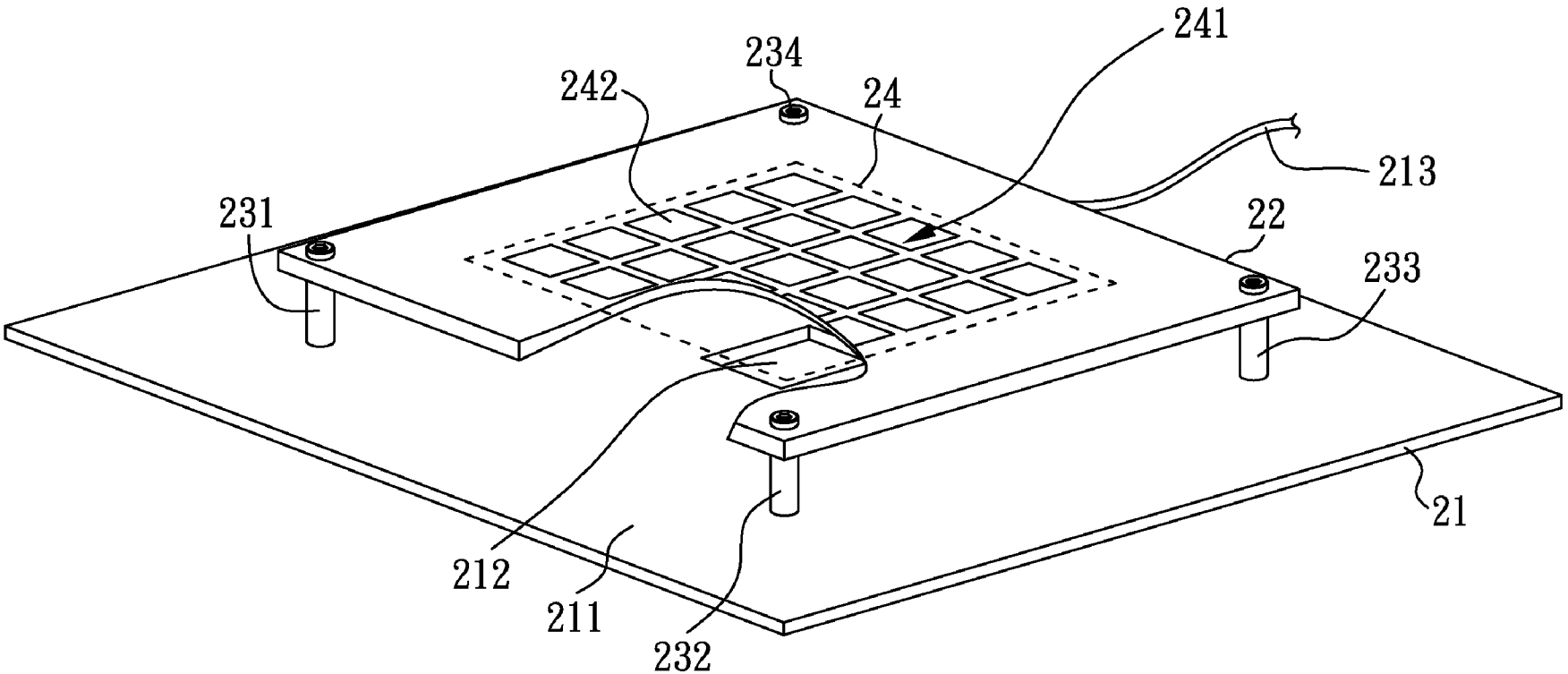
FIG. 2A is a schematic view of the partially reflective antenna of the first preferred embodiment.

FIG. 2A is a schematic view of the partially reflective antenna of the first preferred embodiment. The partially reflective antenna comprises a substrate 21, a reflective sheet 22 and a plurality of supporting units 231, 232, 233, 234. The substrate 21 and the reflective sheet 22 each is an FR-4 microwave substrate with the thickness of 0.8 mm, and each of the supporting units 231, 232, 233, 234 keeps a predetermined distance between reflective sheet 22 and substrate 21, the distance being known as resonant distance. In addition, the supporting units 231, 232, 233, 234 each is composed of electrically insulating material, and the length of the resonant distance is relative to the frequency of the partially reflective antenna of the first embodiment. Generally, the resonant distance is half of the wavelength of the high frequency signal being transmitted or received by the partially reflective antenna of the first embodiment, and therefore the resonant distance is preferably 1.7 cm in this embodiment.

The substrate 21 has an upper surface 211 formed thereon a signal I/O portion 212 for receiving a high frequency signal between 9.25 GHz to 9.55 GHz. In this embodiment, the signal I/O portion 212 is a rectangular slot electrically connected a coaxial cable 213 for receiving or transmitting the high frequency signal. While the partially reflective antenna keeps at the transmitting status, the high frequency signal will reflect between the substrate 21 and the reflective sheet 22. With the partially reflective effect generated by the reflective sheet 22, the high frequency signal will penetrate through the reflective sheet 22 and be transmitted by the partially reflective antenna. This present invention not only can reflect the high frequency signal with the metal portion of the reflective sheet, but also can reflect the signal through non-metal portion of the reflective sheet.

Figure 2B:
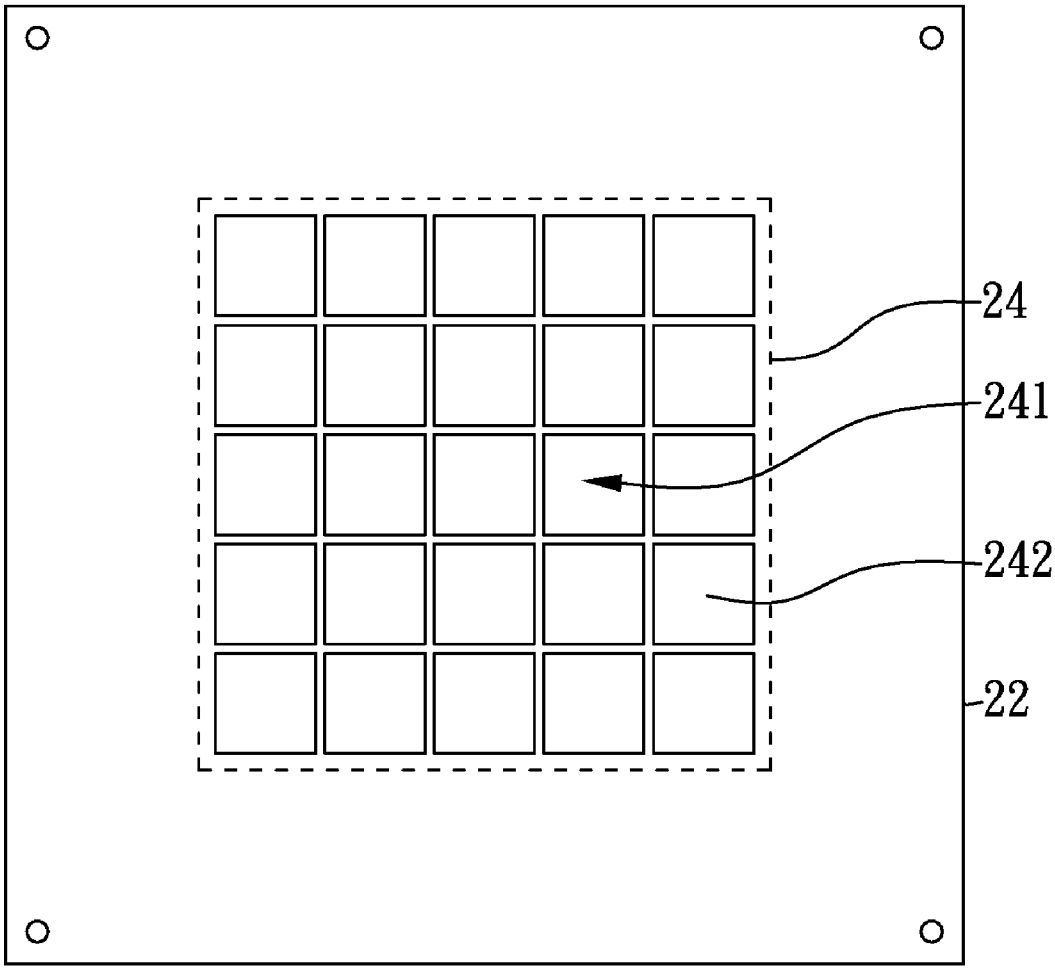
FIG. 2B is a schematic view of the reflective sheet of the partially reflective antenna according to the first preferred embodiment.

Referring to FIGS. 2A and 2B, in this embodiment, the partially reflective antenna comprises an array antenna block 24 located at the center of the surface of the reflective sheet 22, and the area of the array antenna block 24 is 0.31 times of the surface area of the reflective sheet 22. In addition, an antenna array 241 locates at the array antenna block 24 and comprises a plurality of micro-strip reflective units 242. In this embodiment, the antenna array 241 comprises twenty-five micro-strip reflective units 242 for forming as a 5×5 array.

Figure 2C:
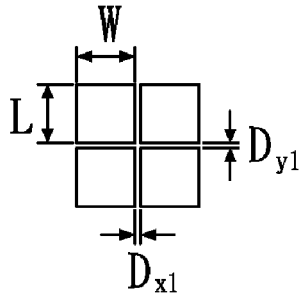
FIG. 2C is a schematic view illustrating the arrangement of the antenna array of the reflective sheet of the partially reflective antenna according to the first preferred embodiment.

On the other hand, referring to the FIGS. 2B and 2C, the reflective sheet 22 is a square-shaped plate with a dimension of 11.4 cm×11.4 cm, and the array antenna block 24 is formed in a square shape with a dimension of 6.4 cm×6.4 cm. In this embodiment, each of the micro-strip reflective units 242 is formed in a square shape with a dimension of 12 mm (L)×12 mm (W). In addition, the distance (Dx1) in the direction of X and the distance (Dy1) in the direction of Y between the two micro-strip reflective units 242 each is 1 mm (Dx1=Dy1=1 mm).

Figure 3A:
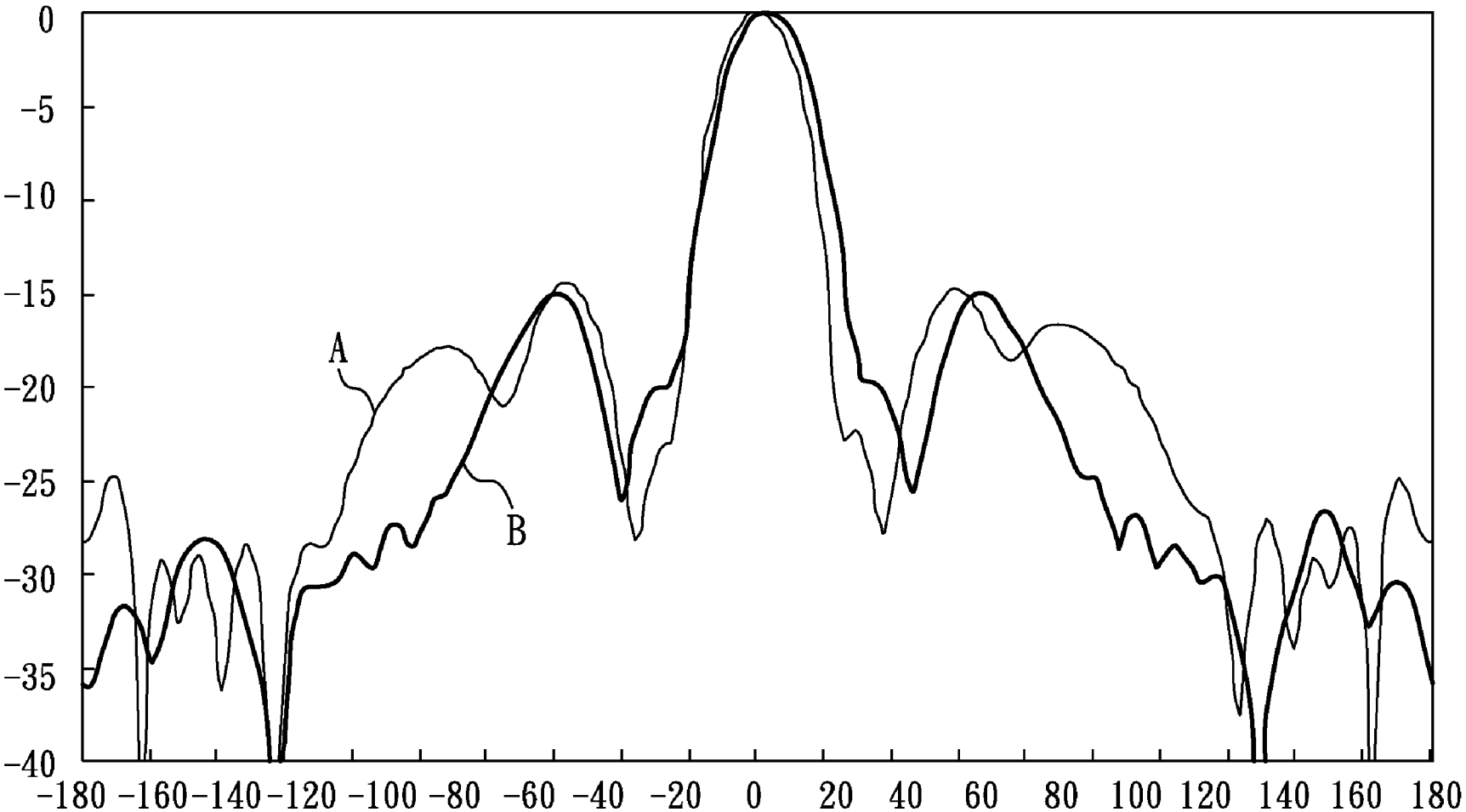
FIG. 3A shows the simulated result of HFSS (High Frequency Structure Simulator) software and the measured result of the wave of the high frequency signal transmitted on H-plane by the partially reflective antenna according to the first preferred embodiment of the present invention.

FIG. 3A shows the simulated result of HFSS (High Frequency Structure Simulator) software and the measured result of the wave of the high frequency signal transmitted on H-plane by the partially reflective antenna according to the first preferred embodiment of the present invention, wherein the curve A is generated by the HFSS software, and the curve B is generated by practical measurement. Referring to FIG.

3A, the simulated result generated by the HFSS software is substantially equal to the result measured result.

Figure 3B:
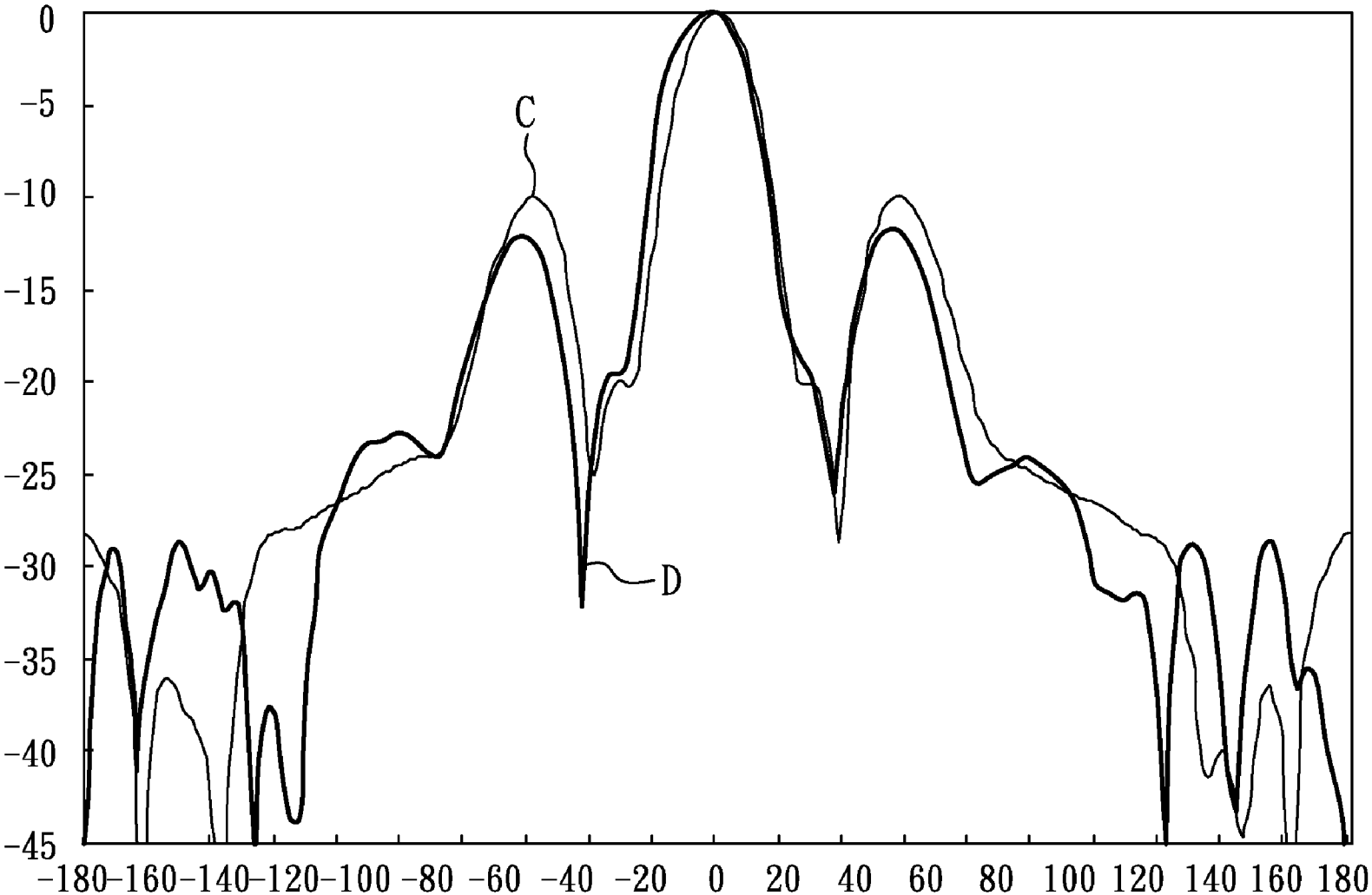
FIG. 3B shows the simulated result of HFSS software and the measured result of the wave of the high frequency signal transmitted on E-plane by the partially reflective antenna according to the first preferred embodiment of the present invention.

FIG. 3B shows the simulated result of HFSS software and the measured result of the wave of the high frequency signal transmitted on E-plane by the partially reflective antenna according to the first preferred embodiment of the present invention, wherein the curve C is generated by the HFSS software, and the curve D is generated by practical measurement. Referring to FIG. 3B, the simulated result generated by the HFSS software is substantially equal to the measured result.

Figure 3C:
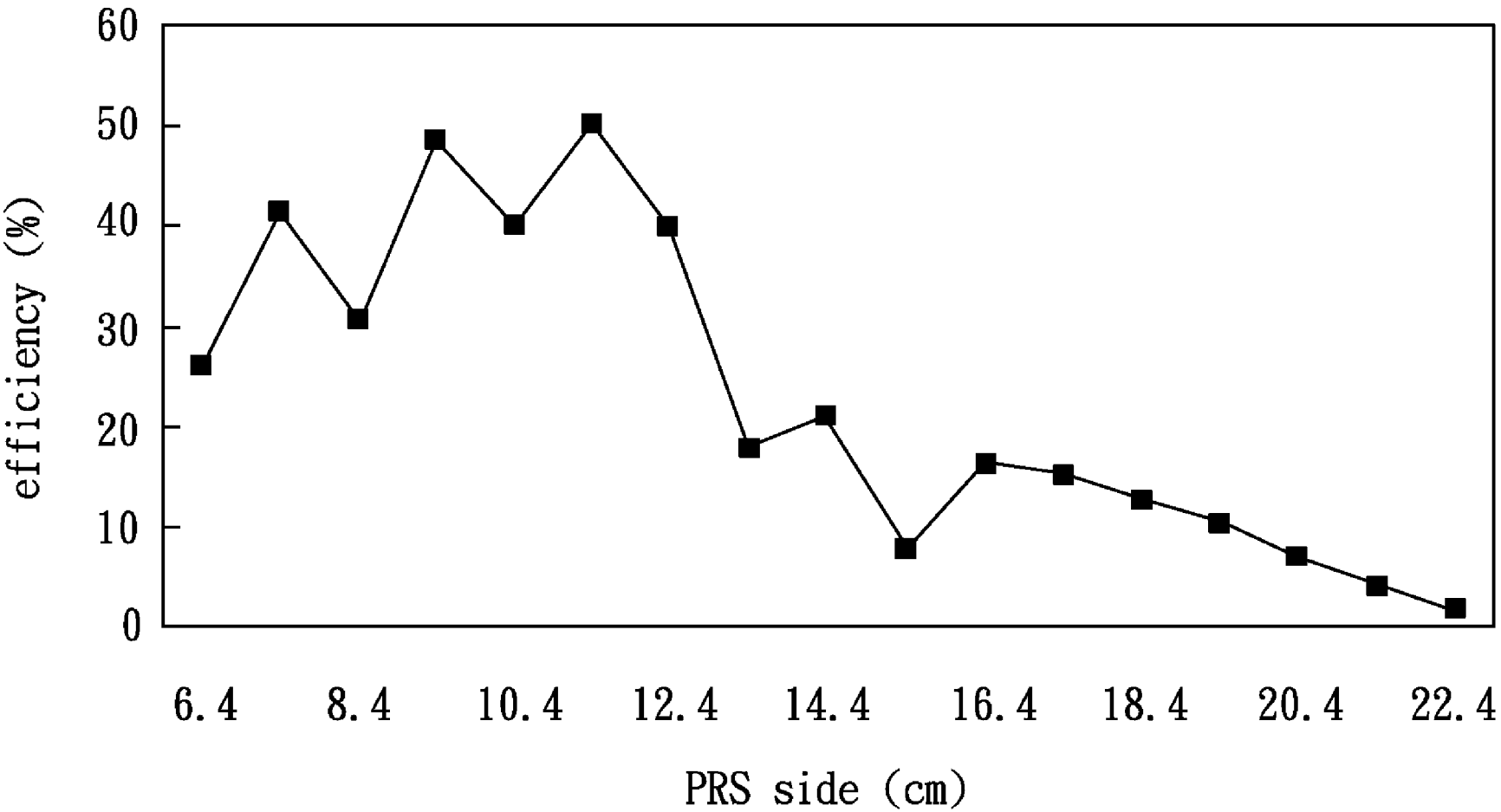
FIG. 3C is a schematic view illustrating the aperture efficiency of the partially reflective antenna generated by the HFSS software relative to the size of the reflective sheet.

FIG. 3C is a schematic view illustrating the aperture efficiency of the partially reflective antenna generated by the HFSS software relative to the size of the reflective sheet, and the aperture efficiency is generated by the following equation (1):

$$\eta=\lambda^2 G/(4\pi A),\square \quad (1)$$

where A is the surface area of the whole reflective sheet with metal and non-metal portions, λ is free space wavelength, and G is the gain generated by performing simulation.

Referring to FIG. 3C, with increase of the side length of the reflective sheet, the aperture efficiency of the partially reflective antenna also gradually increases, and especially the side length is between 6.4 cm and 12.4 cm. In this embodiment, the side length of the reflective sheet is 11.4 cm, and the side length of the array antenna block is 6.4 cm, and the aperture efficiency is fifty percent.

Therefore, in comparison with the conventional partially reflective antenna (the side length of the reflective sheet is slightly larger than the side length of the array antenna block), the conventional partially reflective antenna is not easy to achieve the aperture efficiency with fifty percent. Even the conventional partially reflective antenna may achieve the performance (fifty percent), the conventional partially reflective antenna must fill the metal material up to the surface of the reflective sheet for forming the partially reflective surface. Therefore, while the reflective sheet of the conventional partially reflective antenna is formed in a square-shaped plate with 11.4 cm×11.4 cm, the aperture efficiency is below fifty percent. In this embodiment, while the aperture efficiency achieves to fifty percent, the reflective sheet of the first preferred embodiment has a dimension of 9.4 cm×9.4 cm, and therefore the reflective sheet of this present invention only needs a dimension of 6.4 cm×6.4 cm for achieving the same performance of the conventional partially reflective antenna. Therefore, this present invention not only can increase the aperture efficiency, but also can reduce the manufacturing cost of the reflective sheet.

Figure 4A:
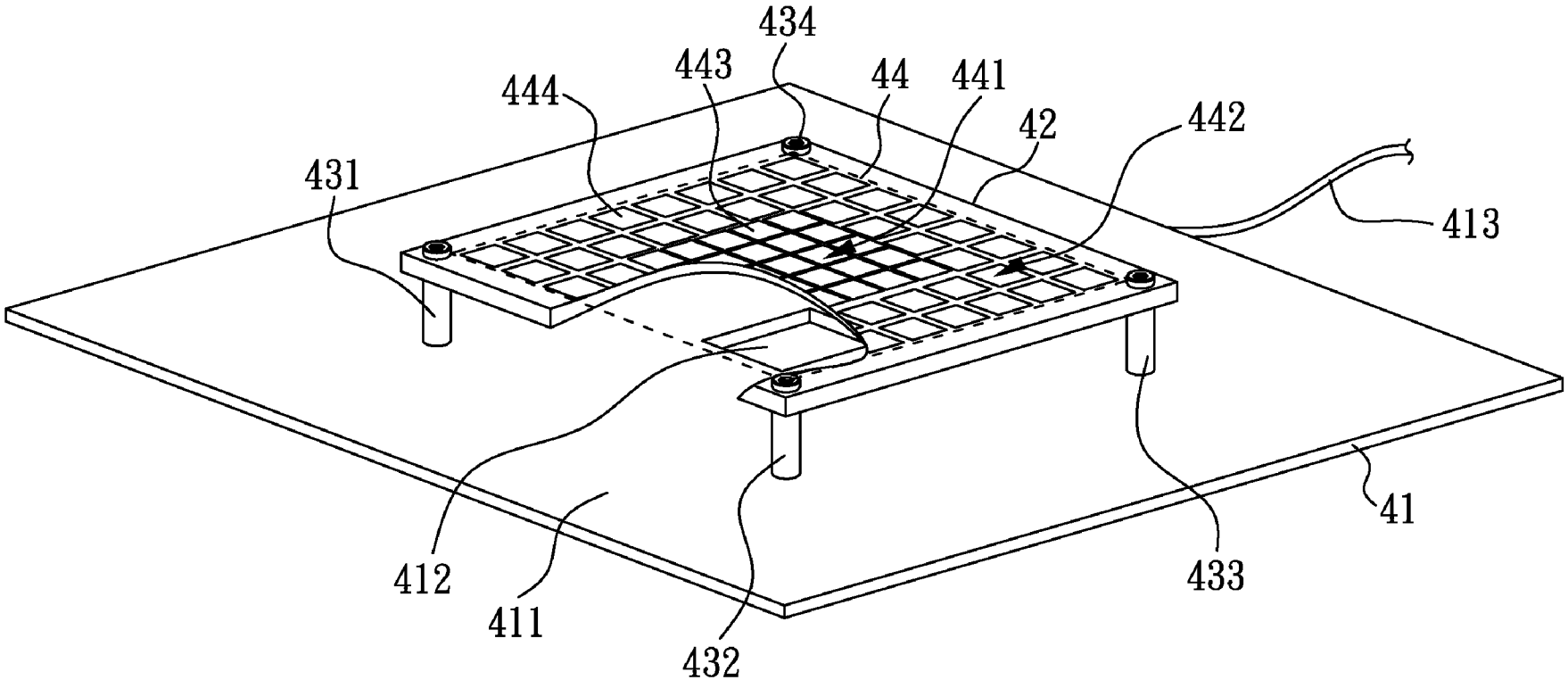
FIG. 4A is a schematic view of the partially reflective antenna of the second preferred embodiment.

FIG. 4A is a schematic view of the partially reflective antenna of the second preferred embodiment. The partially reflective antenna comprises a substrate 41, a reflective sheet 42 and a plurality of supporting units 431, 432, 433, 434. The substrate 41 and the reflective sheet 42 each is an FR-4 microwave substrate with the thickness of 0.8 mm, and each of the supporting units 431, 432, 433, 434 keeps a predetermined distance (resonant distance) with each other. In addition, each of the supporting units 431, 432, 433, 434 is composed of electrically insulating material, and the resonant distance is preferably 1.7 cm in this embodiment.

In addition, the substrate 41 has an upper surface 411 formed thereon a signal I/O portion 412 for receiving and outputting a high frequency signal between 9.25 GHz to 9.55 GHz. In this embodiment, the signal I/O portion 412 is a rectangular slot electrically connected a coaxial cable 413 for receiving or transmitting the high frequency signal. While the partially reflective antenna keeps at the transmitting status of the second preferred embodiment, the high frequency signal will reflect between the substrate 41 and the reflective sheet 42. With the partially reflective effect generated by the reflective sheet 42, the high frequency signal will penetrate through the reflective sheet 42 and be transmitted by the partially reflective antenna of the second embodiment of this prevent invention.

Figure 4B:
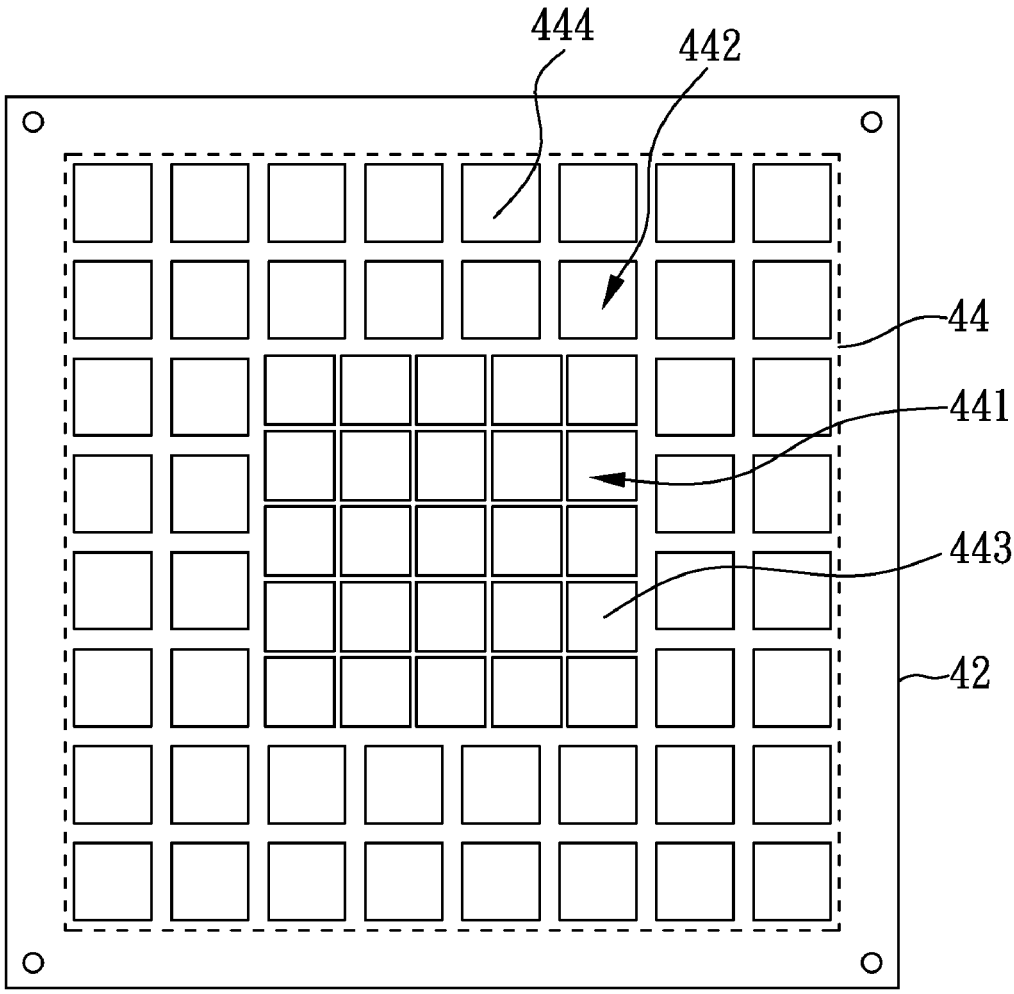
FIG. 4B is a schematic view of the reflective sheet of the partially reflective antenna according to the second preferred embodiment.

Referring to FIGS. 4A and 4B, in this embodiment, the partially reflective antenna comprises an array antenna block 44 located at the center of the surface of the reflective sheet 42, and the area of the array antenna block 44 is 0.72 times of the surface area of the reflective sheet 42. In addition, an antenna array 441 and a second antenna array 442 respectively locate inside the array antenna block 44, and the second antenna array 442 surrounds the first antenna array 441. In this embodiment, the first antenna array 441 comprises twenty-five micro-strip reflective units 443 for forming as a 5×5 array, and the second antenna array comprises forty-eight second micro-strip reflective units 444.

Figure 4C:
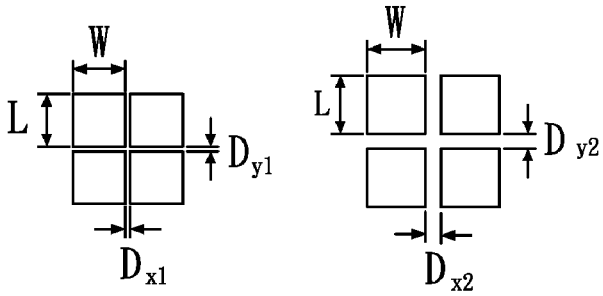
FIG. 4C is a schematic view illustrating the arrangement of the first and second antenna array of the reflective sheet of the partially reflective antenna according to the second preferred embodiment.

On the other hand, referring to the FIGS. 4B and 4C, the reflective sheet 42 is a square-shaped plate with a dimension of 14.5 cm×14.5 cm, and the array antenna block 44 is formed in a square shape with a dimension of 12.4 cm×12.4 cm. In this embodiment, both of the first micro-strip reflective unit 443 of the first antenna array 441 and the second micro-strip reflective unit 444 of the second antenna array 442 are formed in a square shape with a dimension of 12 mm(L)×12 mm(W). In addition, in the first antenna array 441, the distance (Dx1) in the direction of X and the distance (Dy1) in the direction of Y between the two micro-strip reflective units 443 each is 1 mm (Dx1=Dy1=1 mm). Further, in the second antenna array 442, the distance (Dx2) in the direction of X and the distance (Dy2) in the direction of Y between the two micro-strip reflective units 444 each is 4mm (Dx2=Dy2=4 mm).

Figure 5A:
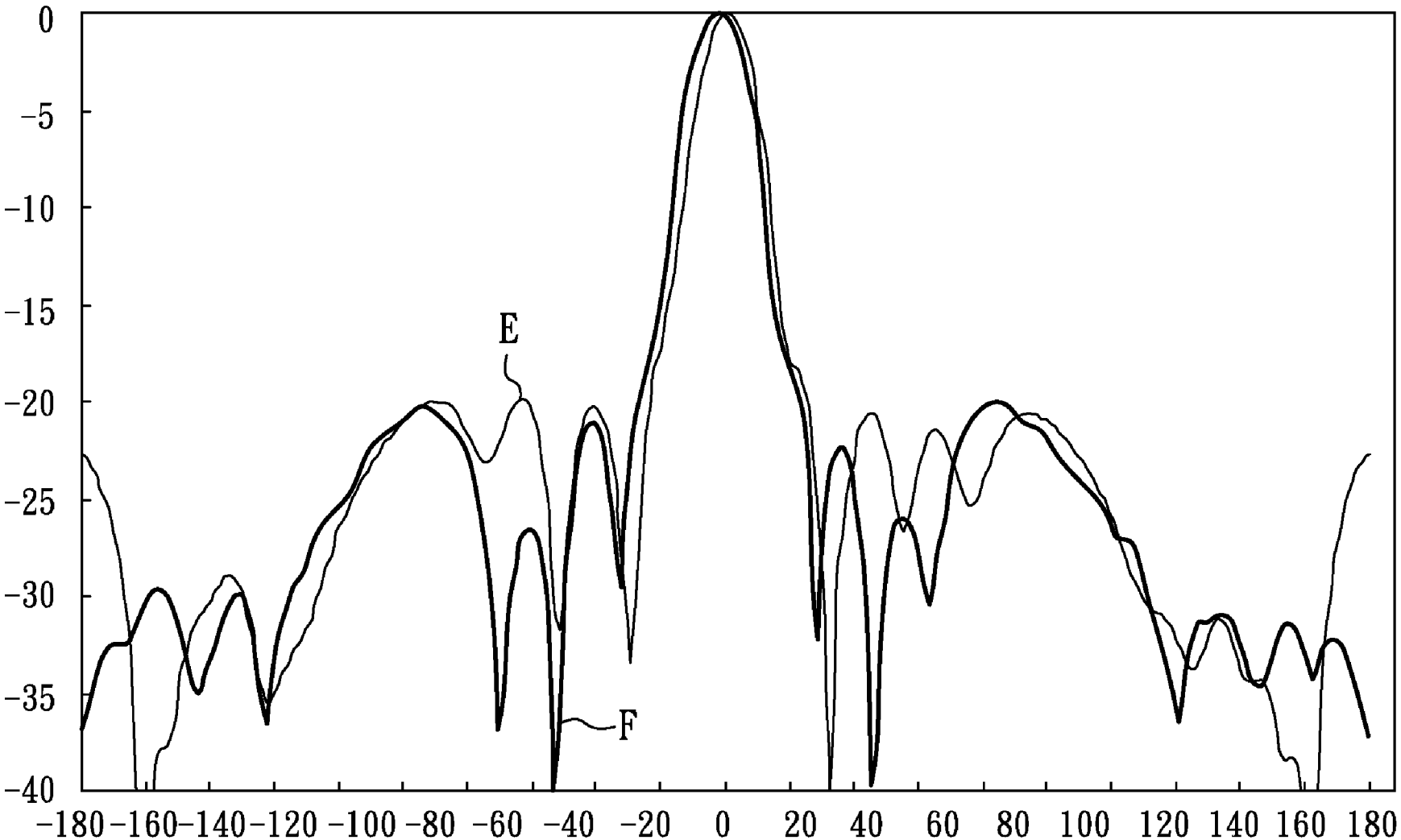
FIG. 5A shows the simulated result of HFSS software and the measured result of the wave of the high frequency signal transmitted on H-plane by the partially reflective antenna according to the second preferred embodiment of the present invention.

FIG. 5A shows the simulated result of HFSS software and the measured result of the wave of the high frequency signal transmitted on H-plane by the partial reflective antenna according to the second preferred embodiment of the present invention, wherein the curve E is generated by the HFSS software, and the curve F is generated by practical measurement. Referring to FIG. 5A, the simulated result generated by the HFSS software is substantially equal to the measured result.

Figure 5B:
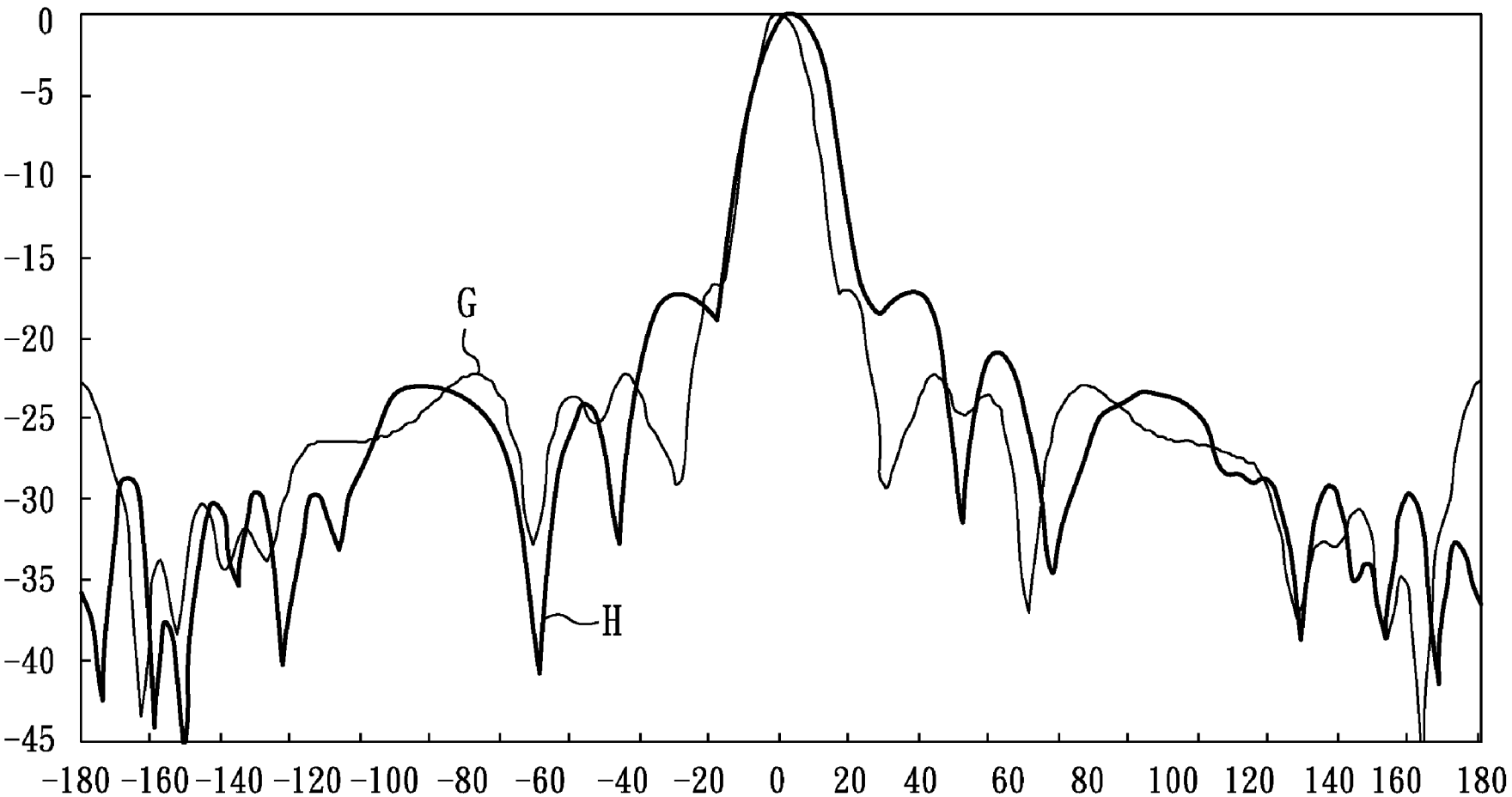
FIG. 5B shows the simulated result of HFSS software and the measured result of the wave of the high frequency signal transmitted on E-plane by the partially reflective antenna according to the second preferred embodiment of the present invention.

FIG. 5B shows the simulated result of HFSS software and the measured result of the wave of the high frequency signal transmitted on E-plane by the partial reflective antenna according to the second preferred embodiment of the present invention, wherein the curve G is generated by the HFSS software, and the curve H is generated by practical measurement. Referring to FIG. 5B, the simulated result generated by the HFSS software is substantially equal to the measured result.

Figure 5C:
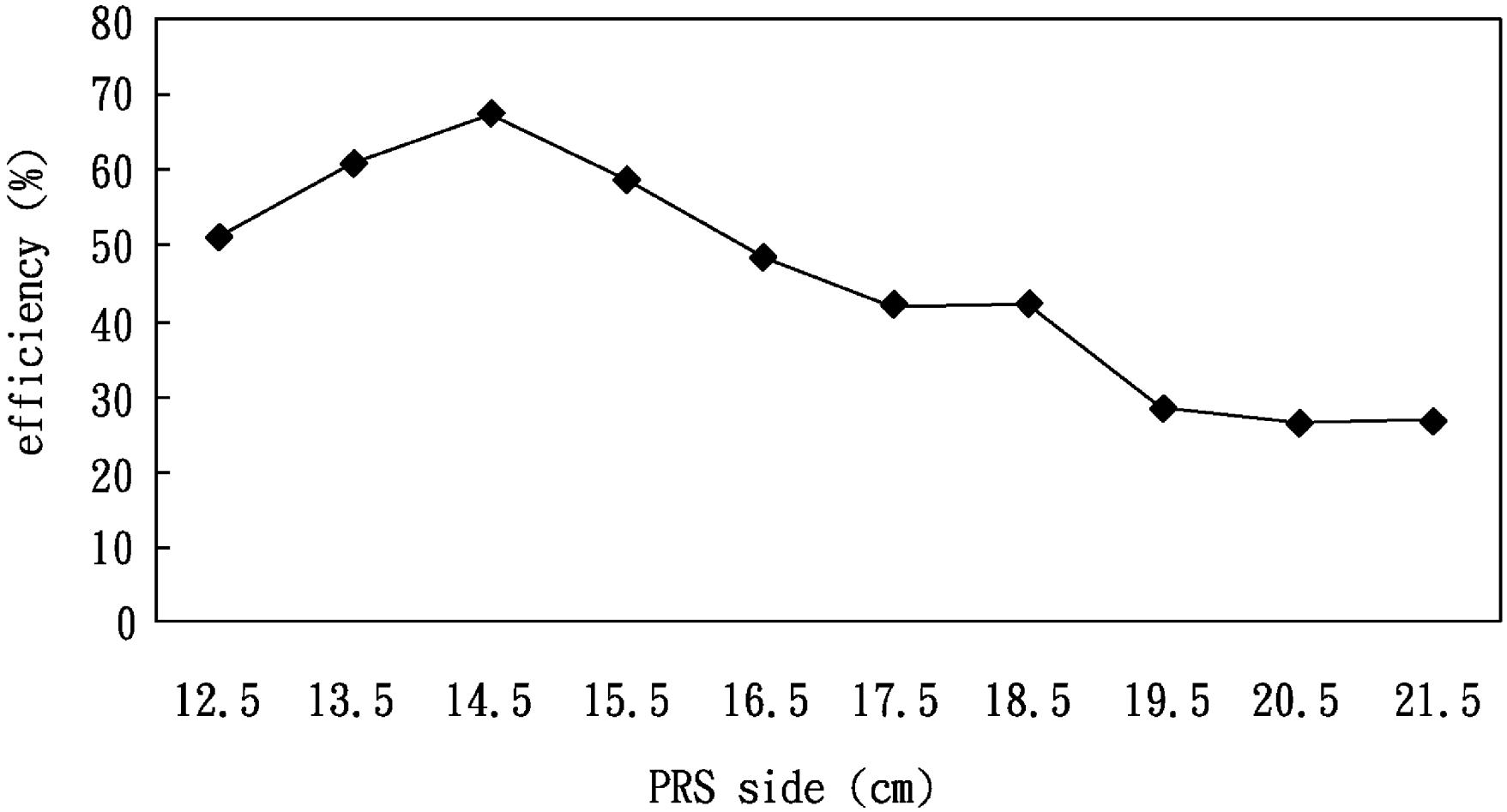
FIG. 5C is a schematic view illustrating the aperture efficiency of the partially reflective antenna generated by the software named HFSS relative to the size of the reflective sheet.

FIG. 5C is a schematic view illustrating the aperture efficiency of the partially reflective antenna generated by the HFSS software relative to the size of the reflective sheet. Referring to FIG. 5C, with increase of the side length of the reflective sheet, the aperture efficiency of the partially reflective antenna also gradually increases, and especially the side length is between 12.5 cm and the 15.5 cm. In this embodiment, the side length of the reflective sheet is 14.5 cm, the side length of the array antenna block is 12.4 cm, and the aperture efficiency is sixty-five percent.

Therefore, in comparison with the conventional partially reflective antenna (the side length of the reflective sheet is slightly larger than the side length of then array antenna block), the highest aperture efficiency of the conventional partially reflective antenna is about fifty percent, but the aperture efficiency of the second embodiment is up to sixty-five percent. The second preferred embodiment only needs a reflective sheet with smaller area for achieving the same performance with the conventional partially reflective antenna so as to reduce manufacture cost.

Figure 6A:
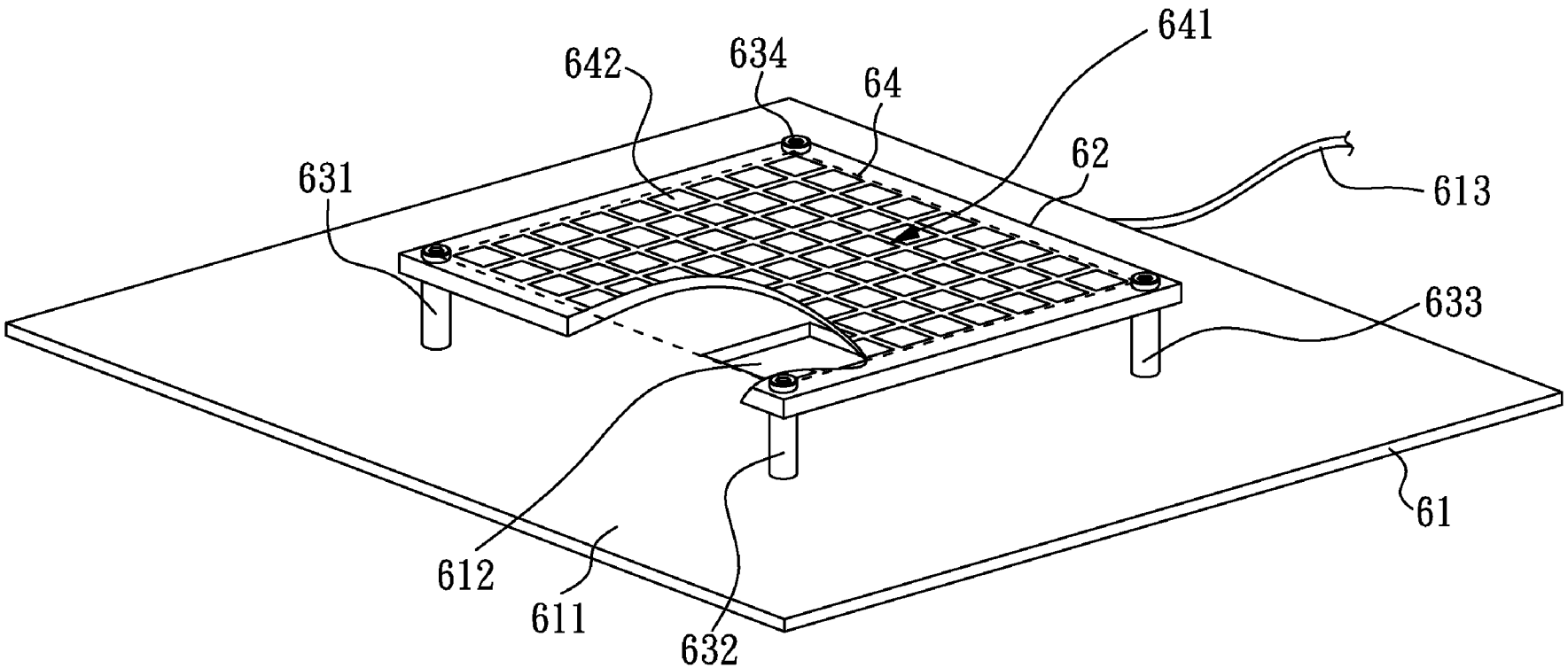
FIG. 6A is a schematic view of the partially reflective antenna of the third preferred embodiment.

FIG. 6A is a schematic view of the partially reflective antenna of the third preferred embodiment. The partially reflective antenna comprises a substrate 61, a reflective sheet 62 and a plurality of supporting units 631, 632, 633, 634. The substrate 61 and the reflective sheet 62 each is an FR-4 microwave substrate with the thickness of 0.8 mm, and each of the supporting units 631, 632, 633, 634 keeps a predetermined distance (resonant distance) with each other. In addition, each of the supporting units 631, 632, 633, 634 is composed of electrically insulating material, and the resonant distance is preferably 1.7 cm in this embodiment.

In addition, the substrate 61 has an upper surface 611 formed thereon a signal I/O portion 612 for receiving and outputting a high frequency signal between 9.25 GHz to 9.55 GHz. In this embodiment, the signal I/O portion 612 is a rectangular slot electrically connected a coaxial cable 613 for receiving or transmitting the high frequency signal. While the partially reflective antenna keeps at the transmitting status of the third preferred embodiment, the high frequency signal will reflect between the substrate 61 and the reflective sheet 62. With the partially reflective effect generated by the reflective sheet 62, the high frequency signal will penetrate through the reflective sheet 62 and be transmitted by the partially reflective antenna of the third embodiment of this prevent invention.

Figure 6B:
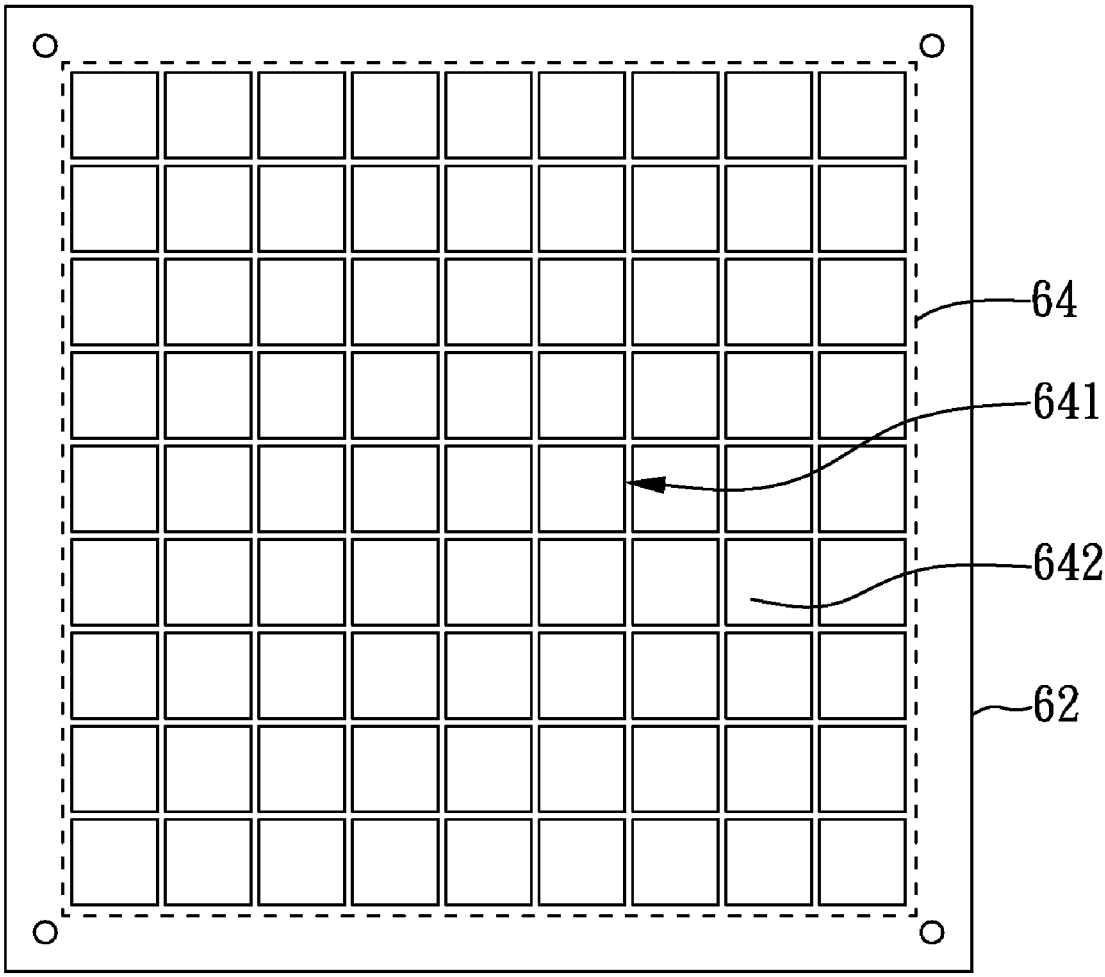
FIG. 6B is a schematic view of the reflective sheet of the partially reflective antenna according to the third preferred embodiment.

Referring to FIGS. 6A and 6B, in this embodiment, the partially reflective antenna comprises an array antenna block 64 located at the center of the surface of the reflective sheet 62, and the area of the array antenna block 64 is 0.74 times of the surface area of the reflective sheet 62. In addition, an antenna array 641 locates at the array antenna block 64 and comprises a plurality of micro-strip reflective units 642. In this embodiment, the antenna array 641 comprises eighty-one micro-strip reflective units 642 for forming as a 9×9 array.

Figure 6C:
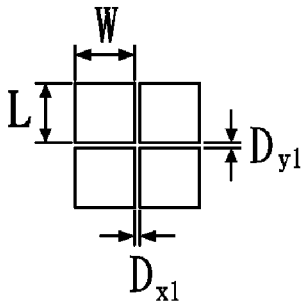
FIG. 6C is a schematic view illustrating the arrangement of the antenna array of the reflective sheet of the partially reflective antenna according to the third preferred embodiment.

On the other hand, referring to the FIGS. 6B and 6C, the reflective sheet 62 is a square-shaped plate with a dimension of 13.5 cm×13.5 cm, and the array antenna block 64 is formed in a square shape with a dimension of 11.7 cm×11.7 cm. In this embodiment, each of the micro-strip reflective units 642 is formed in a square shape with a dimension of 12 mm(L)×12 mm(W). In addition, in the antenna array 641, the distance (Dx1) in the direction of X and the distance (Dy1) in the direction of Y between the two micro-strip reflective units 642 each is 1 mm (Dx1=Dy1=1 mm).

Figure 7:
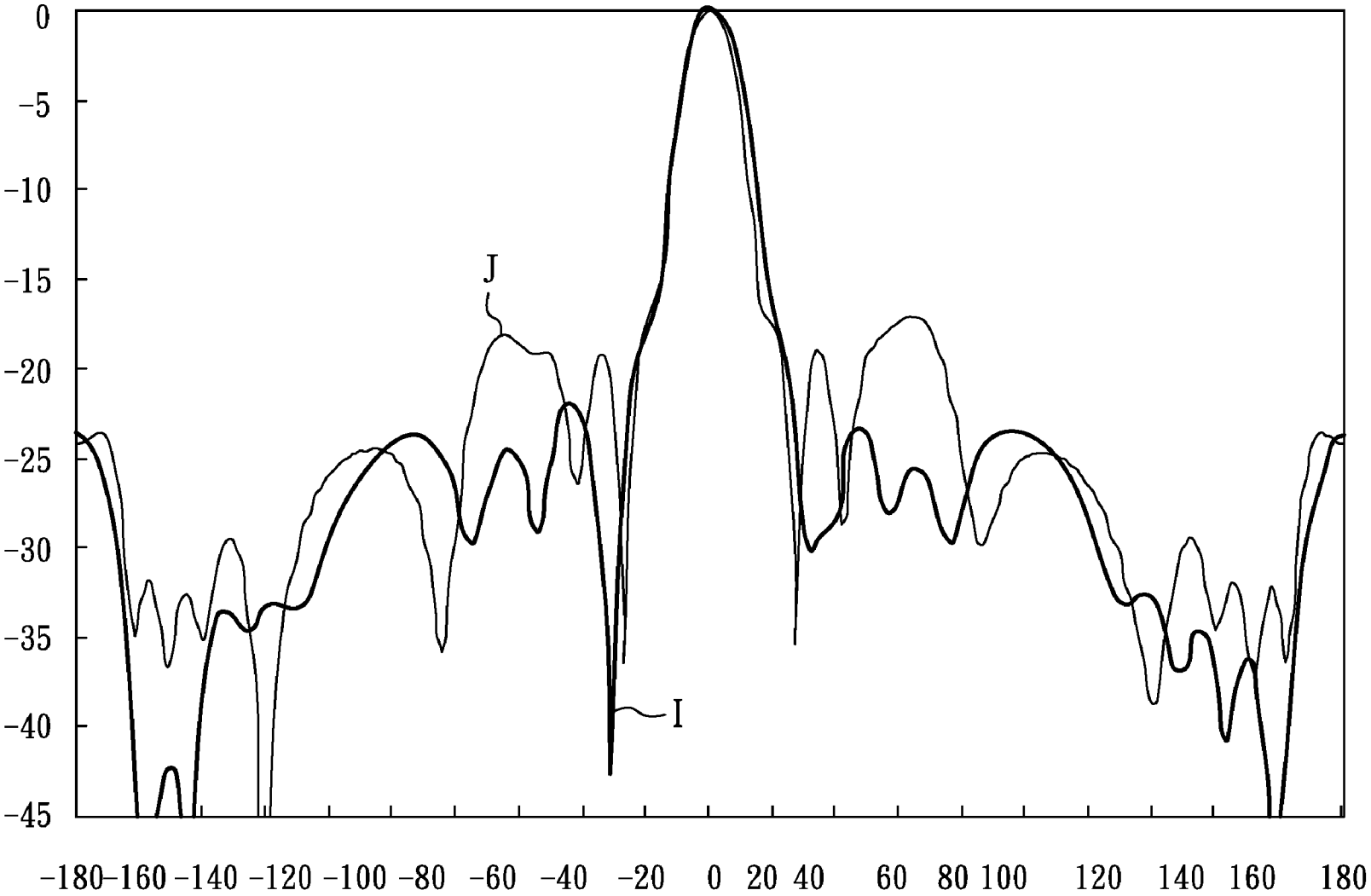
FIG. 7 shows the simulated result of HFSS software of the wave of the high frequency signal transmitted on H-plane by the partial reflective antenna according to the second and third preferred embodiment of the present invention.

FIG. 7 shows the simulated result of HFSS software of the wave of the high frequency signal transmitted on H-plane by the partially reflective antenna according to the second and third preferred embodiments of the present invention, wherein the curve I is the wave of the high frequency signal transmitted by the partially reflective antenna of the second preferred embodiment, and the curve J is the wave of the high frequency signal transmitted by the partially reflective antenna of the third preferred embodiment.

Referring to FIG. 7, due to the two kinds of arrangement of the antenna array disposed inside the array antenna block such as the first antenna array and the second antenna array, the partially reflective antenna of the second and third embodiments has similar ratio of the area of array antenna block to the surface area of the reflective sheet (0.72 and 0.74), but the side lobe level of second embodiment is lower than the side lobe level of the third embodiment on H-plane. Therefore, the energy of the high frequency signal transmitted by the partially reflective antenna of the second embodiment can be centralized to the main lobe for increasing the transmitting distance of the high frequency signal and reducing the noise.

Therefore, by controlling the ratio of the area of array antenna block to the surface area of the reflective sheet to keep between 0.31 to 0.8, this present invention not only can increase the aperture efficiency, but also can reduce the manufacture cost of the micro-strip reflect antenna. Further, by setting two different kinds of arrangement of the antenna array located at the surface of the reflective sheet, this present invention decreases the side lobe of the high frequency signal outputted by the partially reflective antenna, and therefore the present invention can centralize the main lobe of the high frequency signal for increasing the transmitting distance of the high frequency signal and reducing the noise.

Although the present invention has been explained in relation to its preferred embodiment, it is to be understood that many other possible modifications and variations can be made without departing from the scope of the invention as hereinafter claimed.

What is claimed is:

1. A partially reflective surface antenna, comprising:

a substrate having an upper surface formed thereon a signal I/O for receiving and outputting high frequency signal;

a reflective sheet for partially reflecting the high frequency signal, the reflective sheet having a surface area and a surface formed thereon an array antenna block; and a plurality of supporting units for supporting the reflective sheet to locate at the upper surface of the substrate and to maintain a predetermined distance between the reflective sheet and the substrate;

wherein an antenna array located inside the array antenna block includes a plurality of micro-strip reflective units, and the array antenna block has an area ranged from 0.31 to 0.8 times of the surface area of the reflective sheet.

2. The partially reflective surface antenna as claimed in claim 1, wherein the array antenna locates at a center of the surface of the reflective sheet.

3. The partially reflective surface antenna as claimed in claim 1, wherein the area of the array antenna block is 0.31 times of the surface area of the reflective sheet.

4. The partially reflective surface antenna as claimed in claim 1, wherein the array antenna block is formed in a square shape.

5. The partially reflective surface antenna as claimed in claim 1, wherein the micro-strip reflective unit is formed in a square shape.

6. The partially reflective surface antenna as claimed in claim 1, wherein each of the plurality of supporting units is composed of an electrically insulating material.

7. The partially reflective surface antenna as claimed in claim 1, wherein the reflective sheet is a square-shaped plate.

8. The partially reflective surface antenna as claimed in claim 1, wherein the predetermined distance is half of the wavelength of the high frequency signal.

9. A partially reflective surface antenna, comprising:

a substrate having an upper surface formed thereon a signal I/O for receiving and outputting high frequency signal;

a reflective sheet for partially reflecting the high frequency signal, the reflective sheet having a surface area and a surface formed thereon an array antenna block; and a plurality of supporting units for supporting the reflective sheet to locate at the upper surface of the substrate and to maintain a predetermined distance between the reflective sheet and the substrate;

wherein a first antenna array and a second antenna array respectively locate inside the array antenna block, and the second antenna array surrounds the first antenna array; the first antenna array includes a plurality of first micro-strip reflective units, and the second antenna array includes a plurality of second micro-strip reflective units; a distance between the plurality of first micro-strip reflective units is smaller than a distance between the plurality of second micro-strip reflective units, and an area of the array antenna block ranges from 0.31 to 0.8 times of the surface area of the reflective sheet.

10. The partially reflective surface antenna as claimed in claim 9, wherein the array antenna locates at a center of the surface of the reflective sheet.

11. The partially reflective surface antenna as claimed in claim 9, wherein the area of the array antenna block is 0.72 times of the surface area of the reflective sheet.

12. The partially reflective surface antenna as claimed in claim 9, wherein the array antenna block is formed in a square shape.

13. The partially reflective surface antenna as claimed in claim 9, wherein each of the plurality of first micro-strip reflective units is formed in a square shape.

14. The partially reflective surface antenna as claimed in claim 9, wherein each of the plurality of second micro-strip reflective units is formed in a square shape.

15. The partially reflective surface antenna as claimed in claim 9, wherein each of the plurality of supporting units is composed of an electrically insulating material.

16. The partially reflective surface antenna as claimed in claim 9, wherein the reflective sheet is a square-shaped plate.

17. The partially reflective surface antenna as claimed in claim 9, wherein the predetermined distance is half of the wavelength of the high frequency signal.

* * * * *